US005959238A

United States Patent [19]

Bisping et al.

[11] Patent Number: 5,959,238

[45] Date of Patent: Sep. 28, 1999

[54] SUBCALIBER PROJECTILE

[75] Inventors: Bernhard Bisping, Ratingen; Jürgen Kolodzey, Fassberg; Wolfgang Stein, Hermannsburg; Alfons Sackarndt, Unterlüss; Martin Podes, Isernhagen, all of Germany

[73] Assignee: Rheinmetall W & M GmbH, Germany

[21] Appl. No.: 08/984,536

[22] Filed: Dec. 3, 1997

[30] Foreign Application Priority Data

Dec. 6, 1996 [DE] Germany ..... 196 50 740

[51] Int. Cl.[6] ..... F42B 14/06

[52] U.S. Cl. ..... 102/521

[58] Field of Search ..... 102/517–523

[56] References Cited

U.S. PATENT DOCUMENTS

| | | | |
|---|---|---|---|
| 3,446,147 | 5/1969 | Engel et al. | 102/522 |
| 4,249,466 | 2/1981 | Rossmann et al. | 102/521 |
| 4,476,785 | 10/1984 | Hoffman et al. | 102/522 |
| 4,920,889 | 5/1990 | Luther | 102/521 |

FOREIGN PATENT DOCUMENTS

| | | | |
|---|---|---|---|
| 0104 587 A1 | 3/1984 | European Pat. Off. . | |
| 158828 | 10/1985 | European Pat. Off. | 102/520 |
| 3047517 | 7/1982 | Germany | 102/521 |
| WO 88/05896 | 8/1998 | WIPO . | |

*Primary Examiner*—Harold J. Tudor
*Attorney, Agent, or Firm*—Venable; Norman N. Kunitz

[57] ABSTRACT

A subcaliber projectile with a penetrator (4) and a cap (7) that surrounds the front of the penetrator (4) to form an air space therebetween and is tapered toward the penetrator point (6). The cap surface has at least two groove-shaped predetermined break locations (10–12) that extend in the direction of the longitudinal axis (9) of projectile (2). To achieve a secure feeding of the projectile during the firing with automatic weapons on the one hand, and a good strike capability on the other hand, at least one radial recess (15–18) is arranged in each of the groove-shaped predetermined break locations (10–12) in the region of the base half of cap (7), and extends completely through the jacket (14) of cap (7).

8 Claims, 2 Drawing Sheets

SUBCALIBER PROJECTILE

BACKGROUND OF THE INVENTION

The invention relates to a subcaliber projectile with a penetrator and a propelling cage surrounding the penetrator, wherein the base region of a cap that is tapered toward the penetrator point is arranged on the propelling cage.

Such projectiles are used in particular for firing from automatic weapons, wherein the cap, which is arranged on the front of the projectile and is also called a feeding cap, is designed to facilitate the automatic feeding of the respective cartridge into the weapon chamber as well as to protect the penetrator point of the projectile. Providing groove-shaped predetermined break location extending in a longitudinal direction of the projectile will cause a defined cracking of the feeding cap, particularly for spin-stabilized projectiles passing through the weapon tube, so that the corresponding segments of the feeding cap fly off to the side as soon as the projectile leaves the weapon tube.

From the European published patent application EP 0 104 587 A1, it is furthermore known to provide the point region of the cap with slotted openings. However, the publication does not provide any indication as to the purpose of these openings, their preferred arrangement or their dimensions.

In practical operations, it has proven to be a problem that feeding caps, which meet the requirement of a fast and uniform separation when the projectile leaves the tube muzzle, also disintegrate relatively easily during the feeding operation to the weapon chamber. This can lead to considerable malfunctions of the weapons, which can be remedied only at great time expenditure. On the other hand, the problem with projectiles having caps with high strength in the region of the predetermined break locations is that after leaving the weapon tube, the separation is slow and relatively nonuniform, which frequently leads to poor hit or strike results.

It is the object of the present invention to provide a projectile of the aforementioned type, which on the one hand ensures a good and secure feeding during firing with automatic weapons and, on the other hand, has a good strike capability.

SUMMARY OF THE INVENTION

The above object generally is achieved according to the present invention by a subcaliber projectile which comprises: a penetrator having a point at its front end; a propelling cage that surrounds a midportion of the penetrator; and a cap having a base arranged on a front end of the propelling cage and being tapered in a direction of the penetrator point, with the cap forming an air gap between the cap and the penetrator and having at least two groove-shaped predetermined break locations which extend in the direction of the longitudinal axis of the projectile and which also extend respectively from an outer circumferential surface of the cap jacket toward the inside of the cap jacket; and wherein at least one radially extending recess is arranged in each of the groove-shaped predetermined break locations, extends completely through the jacket of the cap, and is arranged in the region of a base half of the cap. Further advantageous embodiments of the invention are disclosed and described in detail.

The invention is essentially based on the idea of arranging at least one radially extending recess in each of the groove-shaped predetermined break locations in the region of the base half of the cap, which recess extends through the jacket of the feeding cap. On the one hand, and as a result of this measure, a very high inside pressure forms inside the cap during the passage of the projectile through the weapon tube, while the air is compressed strongly by the wedge-shaped gap between the cap and tube wall and flows through the recesses into the cap. On the other hand, the recesses arranged at the predetermined break locations ensure that cracks, which may form in the predetermined break locations owing to the high stresses when feeding the projectiles, are not continued.

It has proven advantageous above all if the recesses are round holes with a diameter corresponding to the maximum width of the respective groove-shaped predetermined break location or with a diameter between 1 and 3 mm.

In order to ensure that sufficient compressed air flows into the interior of the cap and increases the inside pressure correspondingly during the relatively long flight time of the projectile through the weapon tube, it has proven advantageous to provide round holes, arranged one after another, in a respective predetermined break location of the cap.

In one particularly advantageous embodiment of the invention, where the cap has three and preferably four groove-shaped predetermined break locations that are distributed evenly about the circumference, four evenly spaced round holes are positioned in each of the groove-shaped predetermined break locations.

Another advantage of the projectile according to the invention consists in that the feeding caps, which generally are made of plastic, can be produced with the injection-molding method on an assembly line, and thus cost-effectively.

Further details and advantages of the invention follow from the description of respective embodiments which are explained in more detail below with the aid of the drawing figures.

DETAILED DESCRIPTION OF THE PREFERRED EMBODIMENT

Figure 1:
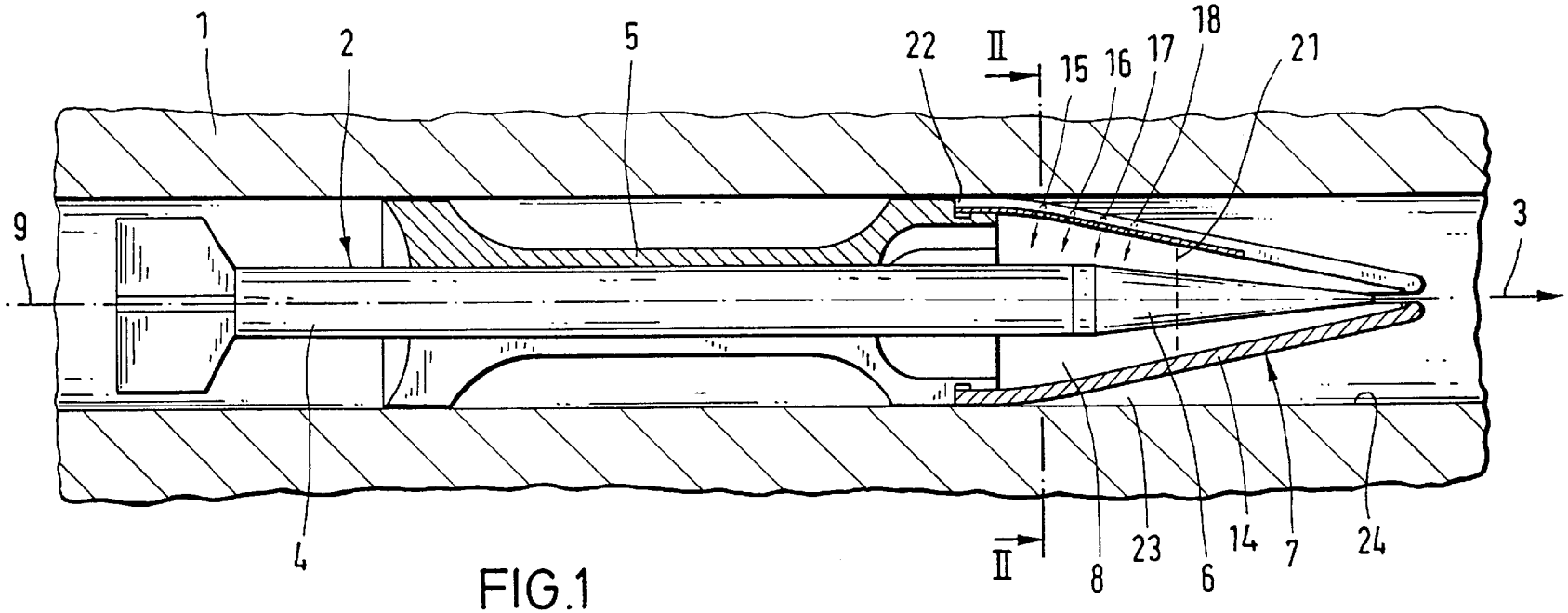
FIG. 1 is a longitudinal sectional view of a projectile with a feeding cap according to the invention, which is positioned in a weapon tube.

Referring to FIG. 1, reference number 1 refers to that segment of the weapon tube, in which a subcaliber, fin-stabilized projectile 2 moves in the direction of arrow 3 toward the muzzle, which is not shown. The projectile 2 essentially comprises a penetrator 4, a propelling cage 5 that consists of several droppable or separable segments disposed about a central portion of the penetrator 4, and a feeding cap 7 that adjoins the front end of the propelling cage 5 and is tapered toward the tip of the penetrator point 6. An air gap 8 exists between the feeding cap 7 and the penetrator 4.

The feeding cap 7 has three groove-shaped predetermined break locations 10–12 (FIG. 2), which are formed in the outer surface of the cap 7, extend in the direction of the longitudinal axis 9 of projectile 2 and which also extend respectively from the outer circumferential surface 13 of the jacket 14 of the cap 7 toward the inside of the jacket 14 for cap 7.

Figure 3:
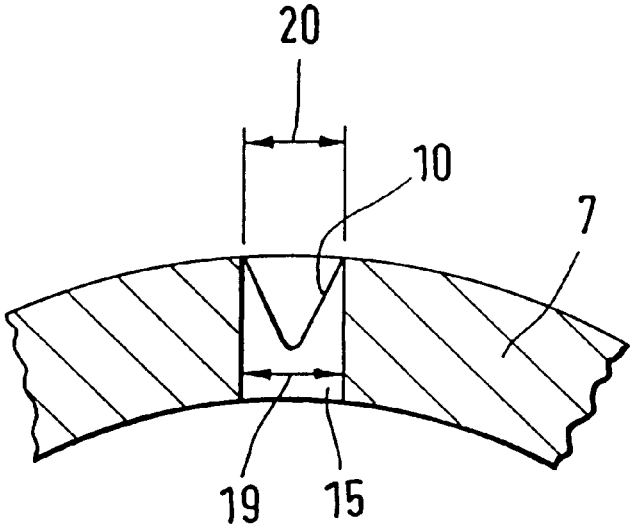
FIG. 3 is an enlarged cutout detail of the feeding cap region III in FIG. 2.

A plurality of radially extending recesses, preferably spaced apart equally, i.e., the four round holes 15–18, are provided in each of the groove-shaped predetermined break locations 10–12 as shown in FIG. 1. Preferably, as can be seen in FIG. 3, the respective diameter 19 of each hole 15–18 corresponds to the maximum width 20 of the respective groove-shaped predetermined break location 10–12. All of the round holes 15–18 are located between the center region 21 of feeding cap 7, as seen in the direction of longitudinal axis 9, and its base region 22 with the same caliber as the propelling cage 5.

Figure 2:
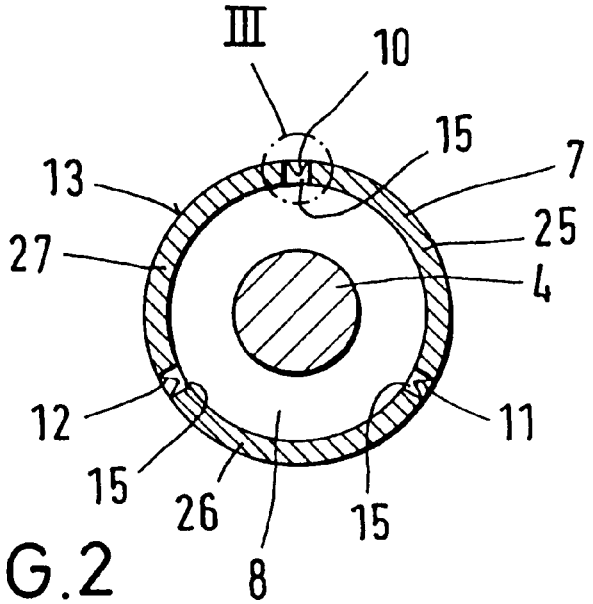
FIG. 2 is a cross sectional view of the projectile shown in FIG. 1, along the cutting line II—II shown there.

The operation of the projectile 2 according to the invention is discussed in more detail in the following. When the projectile 2 passes through the tube, the air in the wedge-shaped gap 23 between cap 7 and the inside wall 24 of tube 1 is compressed and flows through the round holes 15–18. As a result of this, a high pressure builds up in the air gap 8 inside of cap 7. When the projectile 2 leaves the weapon tube 1, then the pressure inside the cap 7 drops relatively slowly and acts upon the three cap segments 25–27 as shown in FIG. 2 defined by the predetermined break locations 10–12, which segments are then cast off the projectile in the usual manner.

The invention naturally is not limited to the aforementioned embodiment. Thus, the projectile according to the invention does not have to be a fin-stabilized or resistance-stabilized projectile. Rather, the projectile can also be a spin-stabilized projectile where, in addition to the cap inside pressure, the centrifugal forces must also be taken into account for the opening or breaking up of the feeding cap 7. As indicated in FIG. 1, the feeding cap 7 can also have a slotted point or tip, so that the cap inside pressure is determined by the provided slots as well as the radial recesses.

The number of recesses 15–18 is determined by the actual design of the respective projectile. More or fewer than four round holes per predetermined break location can therefore be provided. The same is true for the number of predetermined break locations that must be distributed as evenly as possible around the circumferential surface of the cap 7.

Finally, the outer diameter of the base 22 of the feeding cap 7 does not have to correspond exactly to the projectile caliber, but can also be slightly below caliber.

The invention now being fully described, it will be apparent to one of ordinary skill in the art that many changes and modifications can be made thereto without departing from the spirit or scope of the invention as set forth herein.

What is claimed:

1. A subcaliber projectile comprising: a penetrator having a point at its front end; a propelling cage that surrounds a mid portion of the penetrator; and a cap having a base arranged on a front end of the propelling cage and being tapered in a direction of the penetrator point, with the cap forming an air gap between the cap and the penetrator and having at least two groove-shaped predetermined break locations which extend in the direction of the longitudinal axis of the projectile and which also extend respectively from an outer circumferencial surface of the cap toward the inside of the cap; and wherein at least one radially extending recess is arranged in each of the groove-shaped predetermined break locations, extends completely through the cap to open into said air gap, and is a round hole arranged in the region of a base half of the cap.

2. A subcaliber projectile according to claim 1, wherein each of the radial recesses is a round hole having a diameter of which corresponds to a maximum width of the respective groove-shaped predetermined break location.

3. A subcaliber projectile according to claim 2, wherein each of the radially extending recesses is a round hole with a diameter between 1 and 3 mm.

4. A subcaliber projectile according to claim 1, wherein each of the radially extending recesses is a round hole with a diameter between 1 and 3 mm.

5. A subcaliber projectile according to claim 1 wherein the cap is provided with at least three of said groove-shaped predetermined break locations that are distributed evenly over the circumferential surface of the cap.

6. A subcaliber projectile according to claim 1 wherein an outside diameter of the cap has a diameter in its base region which corresponds to the projectile caliber.

7. A subcaliber projectile comprising: a penetrator having a point at its front end; a propelling cage that surrounds a mid portion of the penetrator; and a cap having a base arranged on a front end of the propelling cage and being tapered in a direction of the penetrator point, with the cap forming an air gap between the cap and the penetrator and having at least two groove-shaped predetermined break locations which extend in the direction of the longitudinal axis of the projectile and which also extend respectively from an outer circumferencial surface of the cap toward the inside of the cap; and wherein at least one radially extending recess is arranged in each of the groove-shaped predetermined break locations; extends completely through the cap to open into said air gap, and is arranged in the region of a base half of the cap; and at least two of said radially extending recesses are arranged one after another in the longitudinal direction, in each of the groove-shaped predetermined break locations.

8. A subcaliber projectile according to claim 7, wherein: each of the radically extending recesses is a round hole; and four said round holes, arranged one after another in the longitudinal direction, are provided in each of the groove-shaped predetermined break locations.

* * * * *